US005484961A

United States Patent [19]

Itoh et al.

[11] Patent Number: 5,484,961

[45] Date of Patent: Jan. 16, 1996

[54] TERMINAL CRIMPING METHOD AND CRIMP TERMINAL USED THEREFOR

[75] Inventors: Akira Itoh; Eiji Fudoo; Masayuki Kawamura, all of Yokkaichi, Japan

[73] Assignee: Sumitomo Wiring Systems, Ltd., Japan

[21] Appl. No.: 207,219

[22] Filed: Mar. 8, 1994

[30] Foreign Application Priority Data

Mar. 8, 1993 [JP] Japan ..... 5-046791

[51] Int. Cl.[6] ..... H01R 4/18; H01R 43/048

[52] U.S. Cl. ..... 174/84 C; 29/863; 174/94 R; 439/877; 439/879

[58] Field of Search ..... 174/84 C, 94 R; 439/877, 879, 88; 29/861, 863

[56] References Cited

U.S. PATENT DOCUMENTS

| | | | |
|---|---|---|---|
| 3,275,738 | 9/1966 | Flynn et al. | 174/94 R |
| 3,892,459 | 7/1975 | Dittmann et al. | 174/84 C |
| 4,165,148 | 8/1979 | Campbell et al. | 439/880 |
| 4,214,361 | 7/1980 | Coldren et al. | 29/863 |
| 5,025,554 | 6/1991 | Dohi | 29/860 |
| 5,181,867 | 1/1993 | Rodondi et al. | 439/854 |
| 5,338,233 | 8/1994 | Endo et al. | 439/877 |
| 5,356,318 | 10/1994 | Fry et al. | 439/877 |
| 5,375,317 | 12/1994 | Murakami et al. | 29/753 |

FOREIGN PATENT DOCUMENTS

| | | | |
|---|---|---|---|
| 3921990 | 1/1990 | Germany | 29/863 |
| 2-90486 | 3/1990 | Japan | 29/861 |
| 3-165478 | 7/1991 | Japan . | |

*Primary Examiner*—Morris H. Nimmo

*Attorney, Agent, or Firm*—Beveridge, DeGrandi, Weilacher & Young

[57] ABSTRACT

An opened barrel type crimp terminal having a body of semicircular cross section which surrounds an end of an electric wire. A pair of claws integrally extend from ends of a circular arc of the body and are adapted to be crimped on the end of the electric wire. This invention further includes a method of crimping the crimp terminal on the end of the electric wire. The body containing the end of the electric wire is put on a pressure receiving member. One of the claws extends a predetermined length longer than the other claw. A pressing member is displaced with respect to the pressure receiving member to bend the longer claw above the other claw so that the longer claw laps over the other claw. This crimps the electric wire into the crimp terminal.

12 Claims, 8 Drawing Sheets

FIG. 4
PRIOR ART
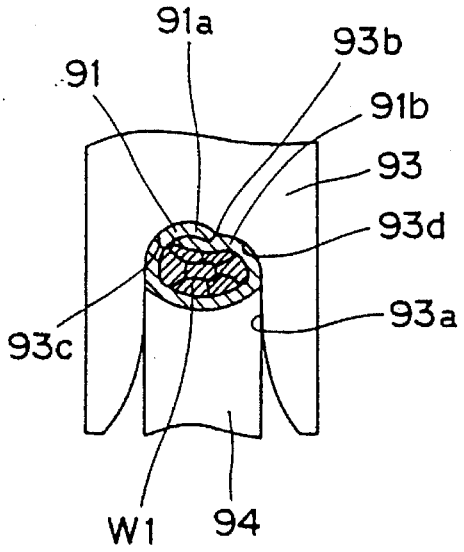
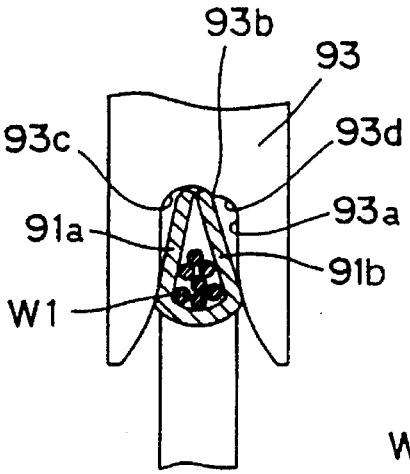
FIG.5A
PRIOR ART
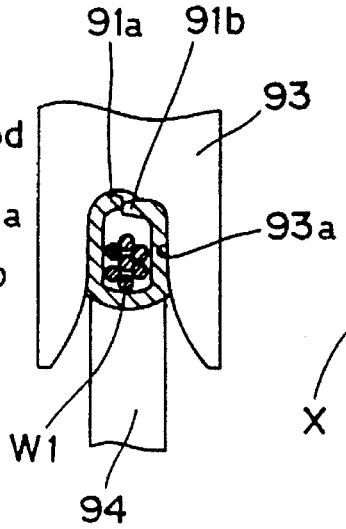
FIG.5B
PRIOR ART
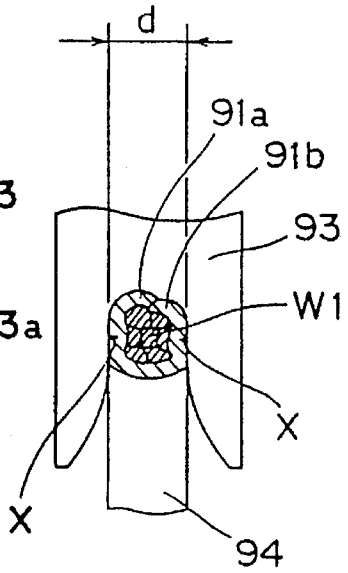
FIG.5C
PRIOR ART

TERMINAL CRIMPING METHOD AND CRIMP TERMINAL USED THEREFOR

CROSS REFERENCE TO RELATED APPLICATION

This application claims priority benefits under 35 USC §119 of Japanese Patent Application Serial No. 5-46791, the disclosure of which is incorporated by reference.

BACKGROUND OF THE INVENTION

1. Field of the Invention

The present invention relates to a terminal crimping method and a crimp terminal used therefor.

2. Description of the Related Art

As one of the crimp terminals crimped on an end of an electric wire, an opened barrel type crimp terminal 90 shown in FIG. 1 has been conventionally known. The crimp terminal 90 comprises a pair of barrel portions. The barrel portions are, respectively, a wire barrel portion crimped on a conductor W1 of an electric wire W and an insulation barrel portion crimped on an insulated end W2 of the electric wire W.

The wire barrel portion includes: a body 900 of semicircular cross section which surrounds the conductor W1 of the electric wire W; and a pair of claws 91*a* and 91*b* integrally extended from ends of a circular arc of the body 900 and adapted to be crimped on the conductor W1. The insulation barrel portion includes claws 92*a* and 92*b* integrally extended from a portion of the body 900 which contains the insulated end W2 of the electric wire W and is adapted to be crimped on the insulated end W2.

In crimping the barrel portions of the crimp terminal 90, crimpers 93 and anvils 94 are used. Specifically, the conductor W1 and the insulated end W2 are respectively introduced into the body 900 of the barrel portions. The barrel portions are put between the two pairs of crimpers 93 and anvils 94 which are opposed to each other in the vertical direction. After that, the crimpers 93 are lowered to crimp the claws 91*a*, 92*a*, 91*b* and 92*b* between the crimpers 93 and the anvils 94, to thereby crimp the terminal 90 on the end of the electric wire W.

As shown in FIG. 2, in a crimping method for the claws 91*a* and 91*b* composing the wire barrel portion, a so-called F-crimp type terminal would be used having claws 91*a* and 91*b* cutting into the conductor W1 of the electric wire W while contacting respective tip ends of the claws 91*a* and 91*b* with each other.

In such a F-crimp type terminal, both claws 91*a* and 91*b* are sufficiently bent. Claw 91*a* and claw 91*b* symmetrically contact each other at the center of the wire barrel portion, thereby making it possible to obtain high reliability of crimping. As shown in FIG. 3, however; the smaller the crimp width d or the width of the wire barrel portion in a crimp terminal due to a thin electric wire W, then the larger the wall thickness t of the claws 91*a* and 91*b* relative to the electric wire W. If such a wire barrel portion is crimped, the claws 91*a* and 91*b* may not be bent as calculated. For example, the claw 91*b* may collide with the claw 91*a*. This insufficient bending of the claws 91*a* and 91*b* can result in inferior reliability of crimping because the claws 91*a* and 91*b* would easily separate due to thermal expansion in use or the like.

As shown in FIG. 4 and FIGS. 5A to 5C, there is proposed a so-called overlap crimping terminal having a pair of claws 91*a* and 91*b* on the wire barrel portion that overlap one another (for example, Japanese Patent Unexamined Publication No. 3-165478).

A crimper 93 used for this overlap crimping terminal has first and second round surfaces 93*c* and 93*d* so smoothly connected with each other so as to provide a step 93*b* therebetween. Both surfaces 93*c* and 93*d* form an innermost portion of a notched groove 93*a* into which the claws 91*a* and 91*b* are introduced (see FIG. 4). Cooperating with an anvil 94, this crimper 93 pushes the wire barrel portion interposed between the crimper 93 and the anvil 94. In this operation, the one claw 91*a* and the other claw 91*b* are respectively located along the corresponding first and second round surfaces 93*c* and 93*d*, so that one claw 91*a* laps over the other claw 91*b* by the step 93*b* between the round surfaces 93*c* and 93*d*.

The foregoing overlap crimping terminal enhances the reliability of crimping better than that of an F-crimp type terminal. Nevertheless, even the claws 91*a* and 91*b* of this overlap crimping terminal may collide in the case of a crimp terminal 90 having a small width d (see FIG. 5C).

The reason for this is that the claws 91*a* and 91*b* of the crimp terminal 90 introduced into the notched groove 93*a* of the crimper 93 meet with each other when the claws 91*a* and 91*b* contact with the first round surface 93*c* (see FIG. 5A), and the crimping operation of the crimp terminal 90 progresses without releasing the contacting state (see FIGS. 5B and 5C). Because such contacting claws 91*a* and 91*b* are hard to overlap, both sides of the wire barrel portion are fractured, so that wrinkled cracks X are produced. In addition, the claws 91*a* and 91*b* can not overlap, so that a crimped portion of the crimp terminal 90 tends to be opened.

Accordingly, what is really needed is a terminal crimping method and a crimp terminal used therefor in which overlap crimping can be reliably carried out.

SUMMARY OF THE INVENTION

The present invention is directed to a terminal crimping method and a crimp terminal used therefor that satisfy this need.

In a preferred mode of the present invention, a crimp terminal is an opened barrel type terminal integrally having a semicircular body and a pair of claws integrally extended from ends of a circular arc of the body. One of the claws at the time of crimping extends a predetermined length longer than the other claw. This longer claw will be bent to overlap the other claw so that the claws do not collide in the crimping process. Claws which differ in length are inclined to each other, whereby the longitudinal claw is guided around the exterior of the other claw.

In a more preferred mode of the present invention, a crimp terminal, before crimping, has claws which differ in length.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 is a cross sectional view showing conventional overlap crimping;

FIGS. 5A to 5C are cross sectional views showing a mechanism of insufficient crimping in the conventional overlap crimping;

DESCRIPTION OF PREFERRED EMBODIMENTS

Figure 1:
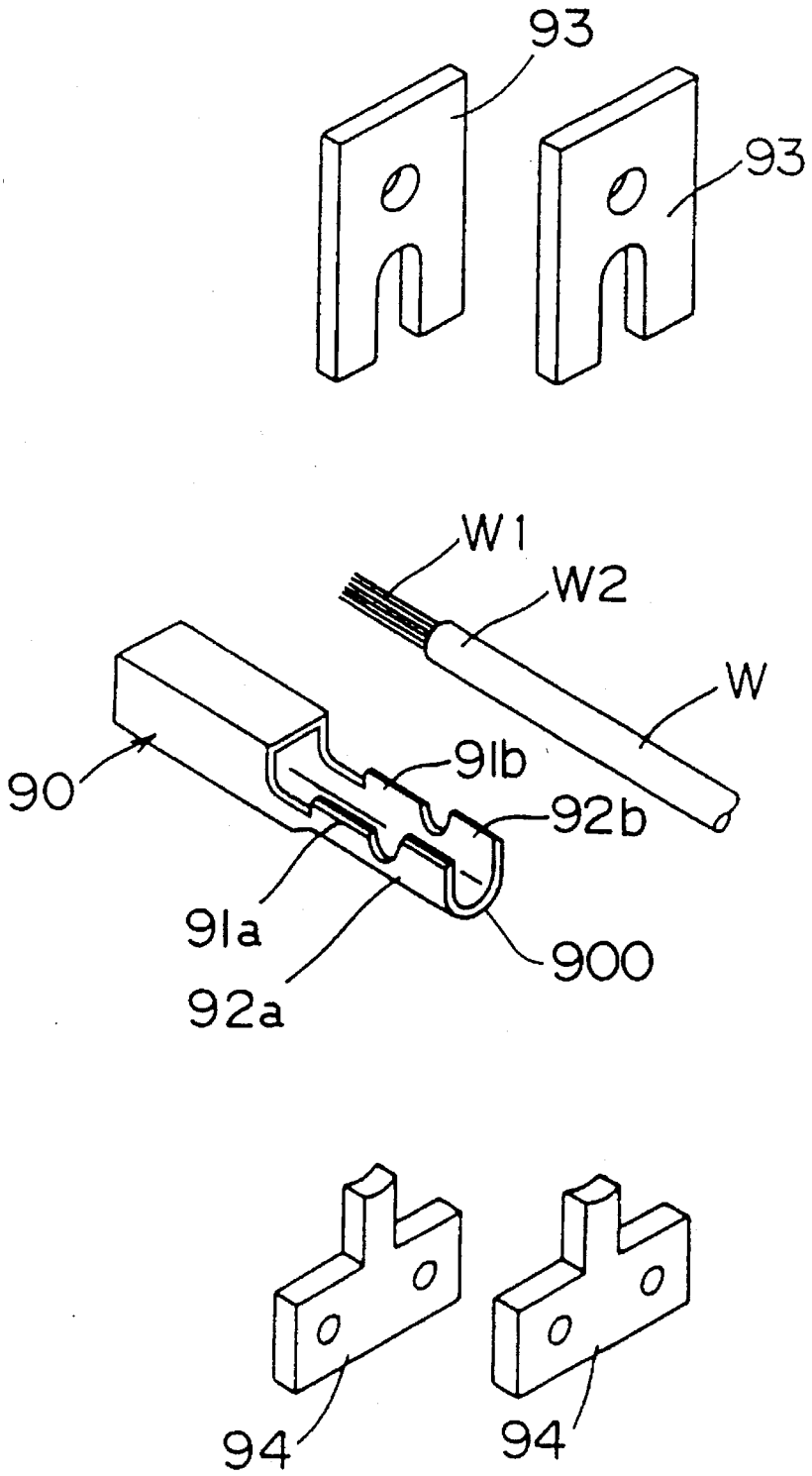
FIG. 1 PRIOR ART
FIG. 1 is a perspective view showing a conventional crimp terminal and terminal crimping apparatus.
Figure 2:
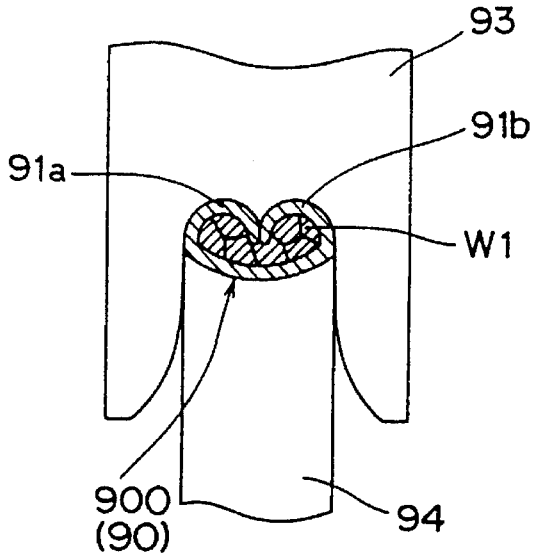
FIG. 2 PRIOR ART
FIG. 2 is a cross sectional view showing a conventional F-crimp type terminal.
Figure 3:
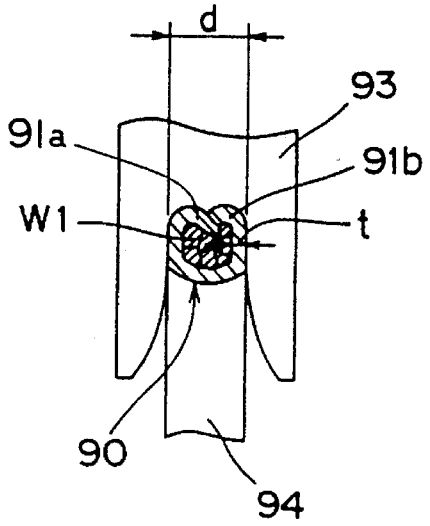
FIG. 3 PRIOR ART
FIG. 3 is a cross sectional view showing insufficient crimping of the F-crimp type terminal.
Figure 6:
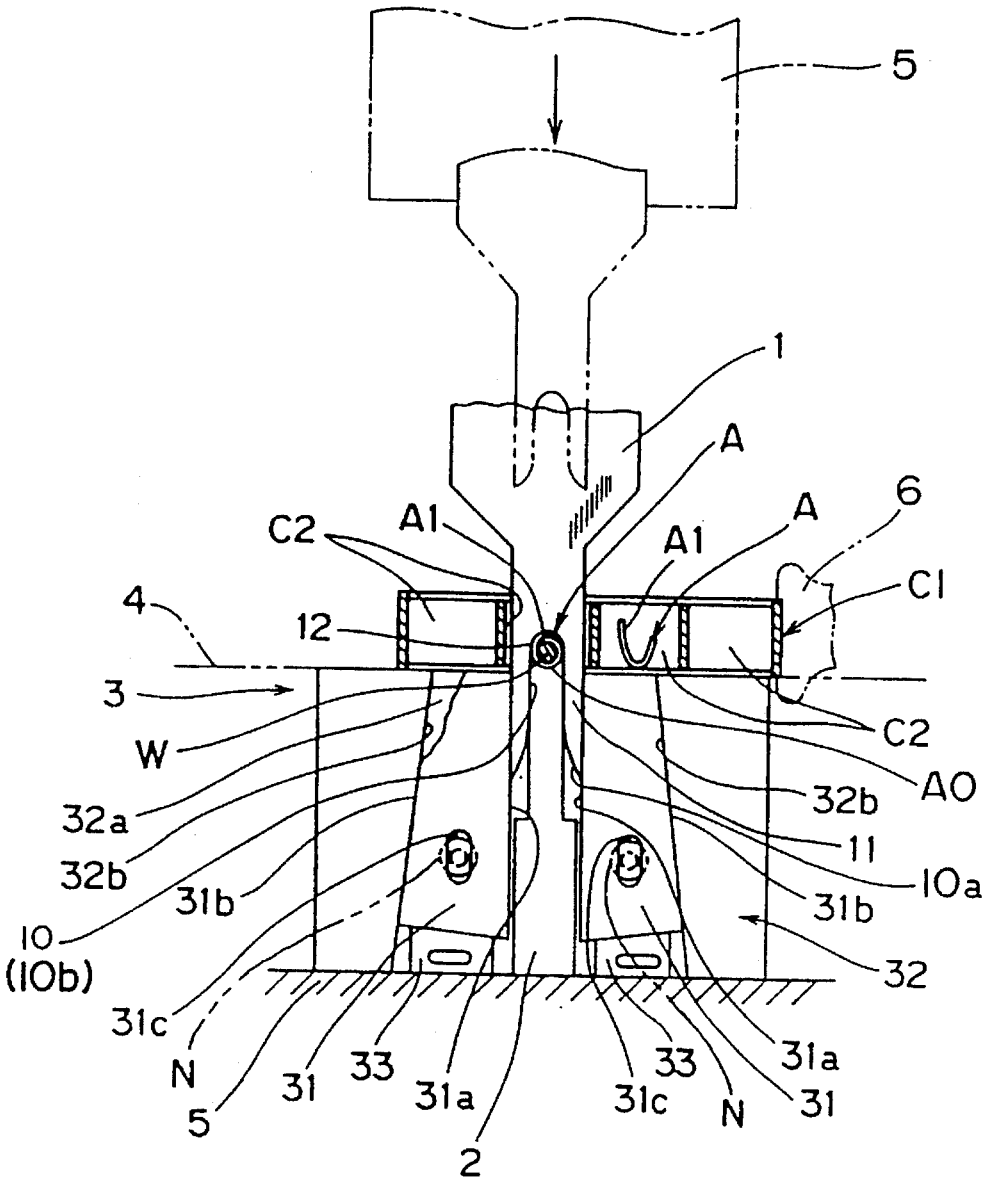
FIG. 6 is a cross sectional view showing a principal part of a terminal crimping apparatus of the invention.

FIG. 6 is a front view showing a principal part of a terminal crimping apparatus according to the present invention. The terminal crimping apparatus comprises a crimper 1 and an anvil 2 for crimping a crimp terminal A into a connector housing C1 that is interposed therebetween, and an end regulating member 3 for clamping a lower end of the crimper 1 to prevent prongs of the crimper 1 from moving apart.

Figure 7:
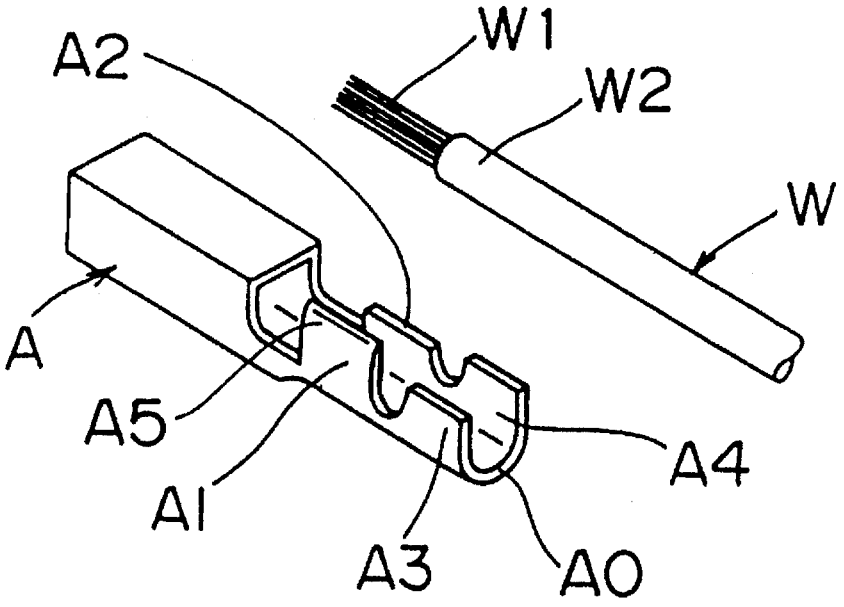
FIG. 7 is a perspective view showing a crimp terminal and an electric wire.

The crimp terminal A comprises a pair of barrel portions as shown in FIG. 7. The barrel portions are, respectively, a wire barrel portion crimped on a conductor W1 of an electric wire W and an insulation barrel portion crimped on an insulated end W2 of the electric wire W.

Wire barrel portion includes: a body A0 of semicircular cross section which surrounds the conductor W1 of the electric wire W; and a pair of claws A1 and A2 which integrally extend from ends of a circular arc of the body A0 and are adapted to be crimped on the conductor W1. The insulation barrel portion includes claws A3 and A4 integrally extended from a portion of the body A0 which contains the insulated end W2 of the electric wire W and is adapted to be crimped on the insulated end W2. The claws A1 and A2 of the wire barrel portion differ in length: one claw A1 extends a predetermined length longer than the other claw A2 so as to have a difference L between their tip ends (see FIG. 8A). It is preferable to form chamfers A5 outside of the tip ends of the claws A1 and A2 for reliable overlap of the claws A1 and A2.

The crimper 1 is located above the connector housing C1 and is movable upwardly or downwardly. Driven by a known pressing mechanism 5, the crimper 1 can press the barrel portions of the crimp terminal A. The crimper 1 has two prongs 11 in its lower end. The prongs 11 can be inserted through a plurality of crimp terminal inserting portions C2 juxtaposing in the connector housing C1. A crotch portion between the prongs 11 forms a notched groove 10 for crimping the claws A1 and A2 of the crimp terminal A in cooperation with the anvil 2.

Referring to FIGS. 8A to 8F, formed on open ends of the notched groove 10 are introduction guiding portions 10*a* for guiding the introduction of the claws A1 and A2. Integrally formed with the introduction guiding portions 10*a* are pressing portions 10*b* for pressing and inclining the claws A1 and A2 in directions in which the claws A1 and A2 come closer to each other. Formed at the innermost portion of the notched groove 10 is a rounded portion 10*c* for bending the claws A1 and A2 so that one claw A1 laps over the other claw A2. The rounded portion 10*c* is a substantially semicircular with a simple round surface 10*c* having a radius r set to satisfy the following equation (1) with respect to the difference L between the claws A1 and A2:

$$\pi r/2 \approx L \quad (1)$$

A groove width D of the pressing portions 10*b* is set to a predetermined width smaller than the entire width d of the claws A1 and A2 of the crimp terminal A. This groove width D allows both the claws A1 and A2 to incline in directions in which the claws A1 and A2 come closer to each other so that a tip end of the one claw A1 and an extension of the tip end of the other claw A2 intersect each other in a substantially central portion of the notched groove 10.

As shown in FIG. 6, the anvil 2 fixed below the connector housing C1 comprises an upper end which projects by a predetermined length from a set position 4 of the connector housing C1. The upper end of the anvil 2 is introduced into the crimp terminal inserting portion C2 in the connector housing C1 when the connector housing C1 is set in the set position 4.

The end regulating member 3 comprises: a pair of clamping members 31 for clamping the prongs 11, a holding member 32 for supporting the clamping member 31 slidable vertically, slidable and spacers 33 for adjusting the height of the clamping members 31. This end regulating member 3 is provided, for clamping the prongs 11 of the crimper 1 in crimping the crimping terminal A, to prevent the prongs 11 from moving.

The clamping member 31 has a vertical surface 31*a* contacting with the prong 11, and a sliding surface 31*b* formed on the opposite side of the surface 31*a*. Sliding surface 31 is inclined upward toward the prong 11. Formed in the clamping member 31 is an insertion hole 31*c* through which a screw N is inserted for fixing the clamping member 31 to the holding member 32. The insertion hole 31*c* is elongated to allow the clamping member 31 to be adjusted vertically.

Furthermore, the holding member 32 comprises a groove 32*a* into which the clamping member 31 can be introduced, and a side wall 32*b* of the groove 32*a* is along the sliding surface 31*b* of the clamping member 31.

The spacer 33 is interposed between a base 5 for fixing the holding member 32 and a bottom surface of the clamping member 31. A butting surfaces of the spacer 33 and the clamping member 31 incline. In addition, the spacer 33 is movable in the horizontal direction along the base 5. By adjusting the amount of the movement in the horizontal direction of the spacer 33, the clamping member 31 will be adjusted vertically. The spacer 33 will be fixed by the screw after the adjustment. Such a vertical adjustment of the clamping member 31 allows the clamping member 31 to have approximately zero clearance with the prong 11.

A punch (not shown) is provided with the foregoing terminal crimping apparatus, wherein the punch is integrally movable with the crimper 1, for crimping the claw A2 of the crimp terminal A around an insulated end W2 of the electric wire W that are interposed between the punch and the bottom of the connector housing C1.

The connector housing C1 is the same as that shown in FIG. 6, and is automatically conveyed by a known conveying member 6. In the present embodiment, crimp terminal inserting portions C2 provided in the connector housing C1 can be arbitrarily moved between the crimper 1 and the anvil 2 by the conveying member 6. Consequently, the crimp terminals A in the crimp terminal inserting portions C2 can be crimped arbitrarily.

Before the crimping process, a measuring and cutting process for cutting the electric wire W to predetermined lengths and a stripping process for stripping the cut electric wire W to expose the conductor in the end of the electric wire W will be carried out. These processes are not shown. An electric wire processing apparatus for embodying the respective processes is disclosed in detail in Japanese Patent Application Serial No. 4-165666, for example.

The crimp terminal A is crimped in the following procedure. First, the conveying member 6 sets the connector housing C1. The crimp terminal A is then inserted into the crimp terminal inserting portion C2 in the connector housing C1 and put on the anvil 2 (see FIG. 8A). The crimper 1 descends into the crimp terminal inserting portion C2 in the connector housing C1 so that the claws A1 and A2 of the crimp terminal A are introduced into the notched groove 10 upon guiding the claws A1 and A2 by the introduction guiding portions 10*a* of the crimper 1 (see FIG. 8B). The pressing portions 10*b* inclines claws A1 and A2 in the directions in which the claws A1 and A2 come closer (see FIG. 8C). The further descent of the crimper 1 effects the longer claw A1 to contact with the rounded portion 10*c* of the notched groove 10 (see FIG. 8D). Consequently, the claw A1 is gradually bent along the rounded portion 10*c* of the notched groove 10 (see FIG. 8E). The crimper 1 descends further so that the longer claw A1 laps over the other claw A2 (see FIG. 8F). In the foregoing processes, the claws A1 and A2 of the crimp terminal A can be crimped on the conductor W1 of the electric wire W.

Because the tip end of the longer claw A1 extends a predetermined length longer than that of the other claw A2 in the direction in which both claws A1 and A2 are introduced into the notched groove 10 of the crimper 1, there is no possibility that the tip ends of the claws A1 and A2 will collide with each other at the innermost portion of the notched groove 10 of the crimper 1. In addition, because the respective claws A1 and A2 are inclined in the directions in which the claws A1 and A2 come closer to each other, a clearance S is formed between the tip end of the claw A2 and the rounded portion 10*c* of the notched groove 10 (see FIG. 8E). This clearance S makes it easy to guide the tip end of the longer claw A1 toward the exterior of the claw A2 when the longer claw A1 is bent along the rounded portion 10*c* to lap over the claw A2. Consequently, thin wire can also be reliably employed in an overlap crimping process.

Because the claws A1 and A2 of the crimp terminal A will be pressed into the notched groove 10 of the crimper 1, the processes of inclining and bending the claws A1 and A2 will continuously be carried out and will be easy and efficient.

Moreover, because the rounded portion 10*c* of the notched groove 10 is a single round surface, manufacturing of the rounded portion 10*c* will be easier than that of the conventional example in which the innermost portion of the notched groove has two round surfaces with a step formed therebetween.

Figures 8A, 8B, 8C, 8D, 8E, 8F:
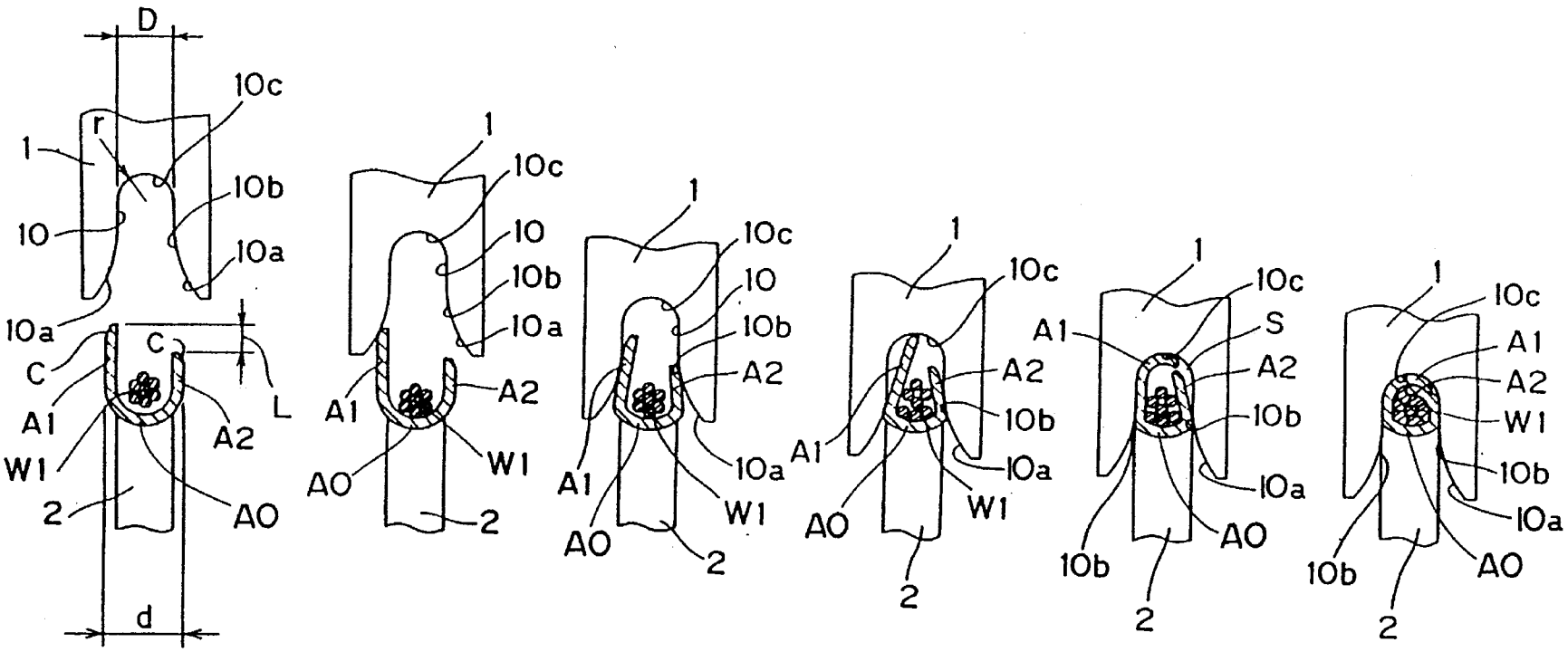
FIGS. 8A to 8F are diagrams showing the process of a terminal crimping method according to the present invention.

Furthermore, because the relationship between the radius r of the rounded portion 10*c* and the difference between the claws A1 and A2 satisfies the foregoing equation (1), the tip end of the claw A2 comes closer to the tip end of the longer claw A1 when bending of the longer claw A1 reaches to approximately three-fourth of the rounded portion 10*c* (see FIG. 8E). This allows the longitudinal claw A1 to lap over the other claw A2 reliably.

Furthermore, when the prongs 11 of the crimper 1 are inserted through the crimp terminal inserting portion C2 the end regulating member 3 prevents the prongs 11 from coming apart, and the claws A1 and A2 of the crimp terminal A can be surrounded with little clearance between the crimper 1 and the anvil 2. Therefore, the claws A1 and A2 can be crimped by applying significant pressure, thereby making it possible to crimp the claws A1 and A2 on the conductor of the electric wire W reliably and firmly.

Figures 9A, 9B, 9C, 9D, 9E, 9F:
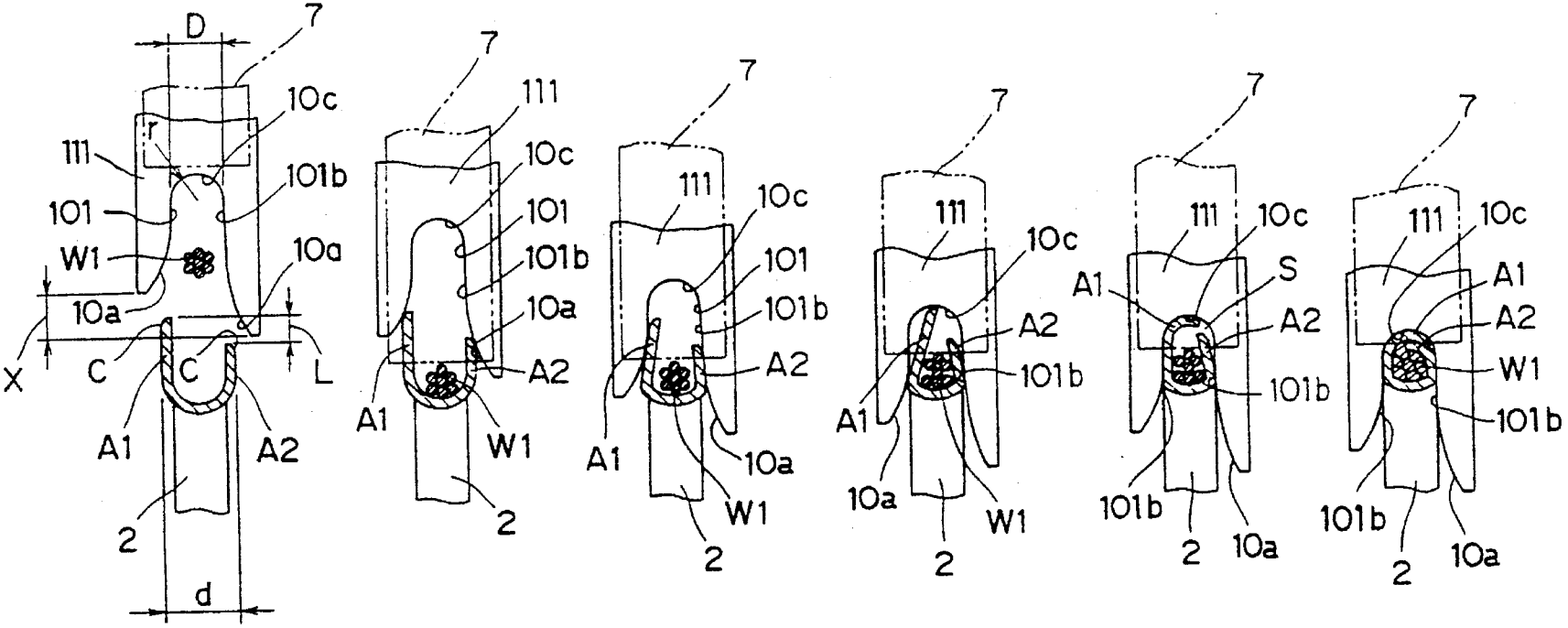
FIGS. 9A to 9F are diagrams showing the process of a terminal crimping method according to another embodiment.
Figure 10:
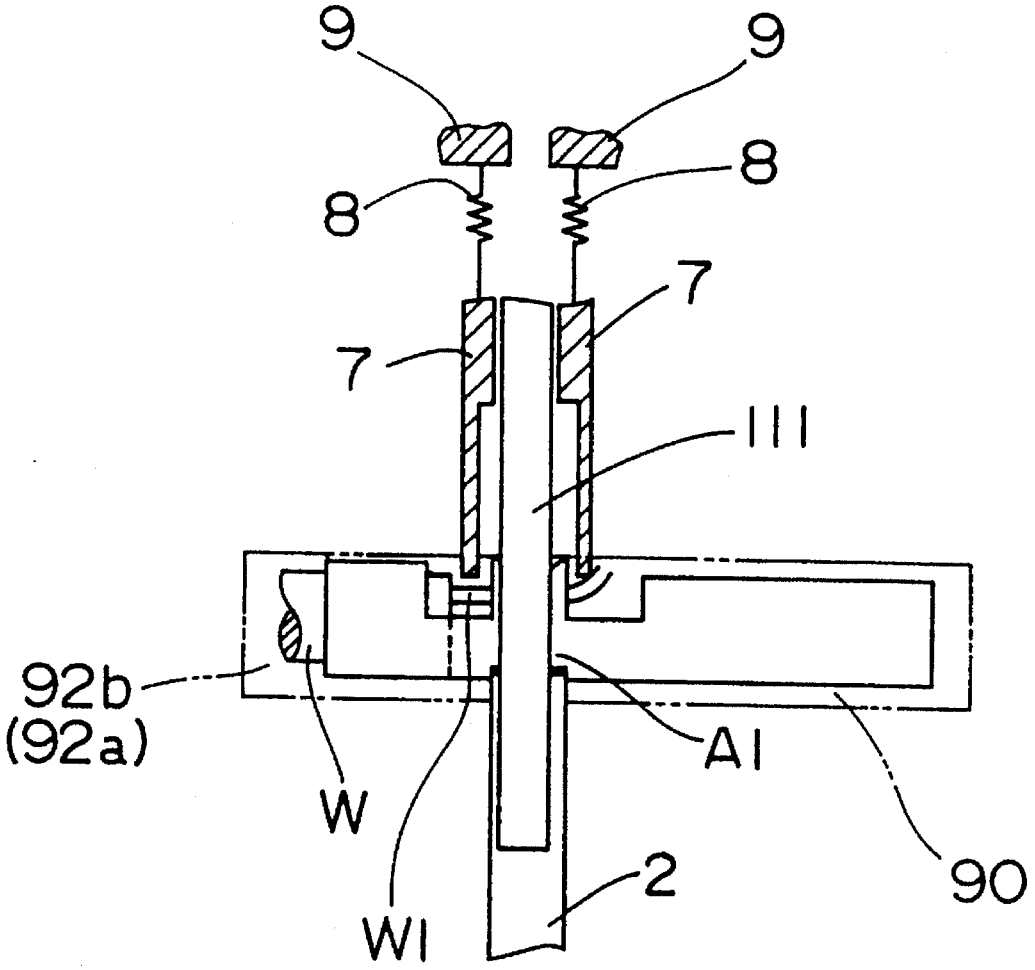
FIG. 10 is a side view of FIG. 9F.

FIGS. 9A to 9F are diagrams showing the process of a terminal crimping method according to another embodiment, and FIG. 10 is a side view of FIG. 9F.

In the present embodiment, a crimper 111 having prongs 101 of an asymmetrical shape is employed. The prongs 101 comprise pressing portions 101*b* which contact with one claw A1 and the other claw A2 of a crimp terminal A at nominally the same time. Specifically, the prongs 101 have a vertical difference X which is approximately equal to a difference L between the length of claw A1 and the length of claw A2 of the crimp terminal A. This difference X allows tip ends of the respective claws A1 and A2 of the crimp terminal A to contact with the pressing portions 101*b* almost at the same time when the crimper 111 and an anvil 2 come closer to each other. In addition, provided on both sides of the crimper 111 are conductor inserting members 7 for inserting a conductor W1 between the claws A1 and A2. The conductor inserting member 7 is provided with an elastic member, such as a compression spring 8, which elastically urges the conductor inserting member 7 (see FIG. 10). The conductor inserting member 7 is movable vertically and independently from the crimper 111 by a driving member 9. The conductor inserting members 7 are lowered at the same time that the crimper 111 starts descent movement while the conductor inserting members 7 are faster than the crimper 111. As a result, the conductor inserting members 7 push the conductor W1 between the claws A1 and A2 before the crimping process is started (see FIG. 9B). After the conductor inserting members 7 descend by a predetermined stroke, the members 7 halt at the certain positions and, until the caulking process is terminated, the members 7 continuously urge the conductor W1 by exclusively applying the urging force of the elastic member 8 which is weaker than that of the crimper 111 (see FIGS. 9C to 9F).

In place of the above described construction, the crimper 111 and the conductor inserting members 7 may be driven vertically using a conventional pressing mechanism. In this case, a lower end of the conductor inserting member 7 may be extended downward lower than a rounded portion of the crimper 111. The remaining portions are the same as those of the foregoing embodiment shown in FIGS. 6 to 8F, so the description thereof is omitted by assigning the same reference numerals to the same members.

According to the above described embodiment, the tip ends of the claws A1 and A2 of the crimp terminal A can contact with the crimper 111 almost at the same time that the crimper 111 comes close to the anvil 2, thereby to make it possible to prevent the crimp terminal A from rotating around an axis. Therefore, it is also possible to stably push the conductor W1 between the claws A1 and A2 by the conductor inserting members 7. Moreover, the conductor inserting members 7 constantly and elastically urge the conductor W by the urging force of the elastic member 8 after pushing the conductor W1, thereby making it possible to prevent the conductor W1 from sticking out between the claws A1 and A2. The terminal can also be prevented from revolving at the time shown in FIG. 9E. Consequently, it is possible to further increase the reliability of terminal crimping.

Although, in the above described embodiment, the difference L is formed between the claws A1 and A2, such a difference may be between claws A3 and A4. In addition, any crimp terminal may be used in the present invention, provided that it has at least a pair of claws A1 and A2.

Furthermore, various design changes can be made. For example, the rounded portion 10*c* of the notched groove 10 of each of the crimpers 1 and 111 may be two round surfaces with a step provided therebetween.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A terminal crimping method for crimping an opened barrel type crimp terminal on an end of an electric wire, wherein the opened barrel type crimp terminal has a body of semicircular cross section, which surrounds the end of the electric wire; and the crimp terminal further includes a pair of claws integrally extended from ends of a circular arc of the body and adapted to be crimped on the end of the electric wire, the terminal crimping method comprising the steps of:

placing a body of an opened barrel type crimp terminal containing an end of an electric wire on a stationary pressure receiving means;

providing a pair of claws on the body of the crimp terminal, wherein a first claw of the pair is a predetermined length longer than a second claw of the pair with respect to a direction extending toward a movable pressing means, such that the pair of claws is capable of crimping the crimp terminal with the end of the electric wire; and displacing the pressing means toward the pressure receiving means to thereby bend the first claw above the second claw so that the first claw laps over the second claw.

2. The terminal crimping method according to claim 1, wherein:

in the displacing step, the first claw is bent by a rounded portion formed on the pressing means.

3. The terminal crimping method according to claim 2, wherein:

the rounded portion is a substantially semicircular shape having a radius r set to satisfy the following equation:

$$\pi r/2=L,$$

wherein L represents a difference between a length of the first claw and a length of the second claw.

4. The terminal crimping method according to claim 2, further comprising:

inclining tip ends of the claws in a direction in which the claws come closer to each other before the first claw laps over the second claw, wherein a clearance is defined between the tip end of the second claw and the rounded portion of the pressing means.

5. The terminal crimping method according to claim 4, wherein:

the first claw and the second claw are inclined relative to each other by contacting each claw with the pressing means at the same time during the displacing step.

6. The terminal crimping method according to claim 4, further comprising:

pushing the electric wire in an elastic manner toward the body prior to the step of inclining the tip ends of the claws in the direction in which the claws come closer to each other.

7. An opened barrel type crimp terminal, comprising:

a body having a semicircular cross section which is adapted to surround an end of an electric wire, and a pair of claws integrally extending from ends of a circular arc of the body, wherein the claws are adapted to be crimped on the end of the electric wire, wherein:

a first claw of the pair extends a predetermined length longer than a second claw of the pair.

8. The crimp terminal according to claim 7, wherein:

the body and the pair of claws compose a wire barrel portion adapted to be crimped on a conductor of the electric wire.

9. The crimp terminal according to claim 7, wherein the crimp terminal further includes an integral insulation barrel portion which is adapted to be crimped on an insulated portion of the electric wire.

10. A terminal comprising:

an opened barrel crimp terminal including a circular arc body portion having a semicircular cross section adapted to surround an end of an electric wire, a pair of claws integrally extending from ends of the circular arc body, wherein the claws are adapted to be crimped on the end of the electric wire, wherein a first claw of the pair extends a predetermined length longer than a second claw of the pair, and an electric wire including a conductor portion at the end of the wire, wherein the conductor portion is crimped with the claws of the terminal.

11. The terminal according to claim 10, wherein the electric wire further includes an insulated portion, and the circular arc body of the crimp terminal further includes an insulation barrel portion, wherein the insulation barrel portion is crimped on the insulated portion of the electric wire.

12. The terminal according to claim 11, wherein the insulation barrel portion of the crimp terminal includes a second pair of claws which crimp to the insulated portion of the electric wire.

* * * * *